US005241650A

United States Patent [19]

Gerson et al.

[11] Patent Number: 5,241,650

[45] Date of Patent: Aug. 31, 1993

[54] DIGITAL SPEECH DECODER HAVING A POSTFILTER WITH REDUCED SPECTRAL DISTORTION

[75] Inventors: Ira A. Gerson, Hoffman Estates; Mark A. Jasiuk, Chicago, both of Ill.

[73] Assignee: Motorola, Inc., Schaumburg, Ill.

[21] Appl. No.: 870,199

[22] Filed: Apr. 13, 1992

Related U.S. Application Data

[63] Continuation of Ser. No. 422,926, Oct. 17, 1989, abandoned.

[51] Int. Cl.[5] ..... G10L 9/14

[52] U.S. Cl. ..... 395/2

[58] Field of Search ..... 395/2; 381/29-40

[56] References Cited

U.S. PATENT DOCUMENTS

| | | | |
|---|---|---|---|
| 4,301,329 | 11/1981 | Taguchi | 381/37 |
| 4,617,676 | 10/1986 | Jayant et al. | 381/31 |
| 4,817,157 | 3/1989 | Gerson | 381/40 |
| 4,852,169 | 7/1989 | Veeneman et al. | 381/36 |

OTHER PUBLICATIONS

"Improved Speech Quality and Efficient Vector Quantization is SELP" by W. Kleijn et al. in Apr., 1988 issue of Proceedings of the ICASSP, pp. 155-158.

"A Class of Analysis-by-Synthesis Predictive Coders for High Quality Speech Coding at Rates Between 4.8 and 16 kbits/s" by Peter Kroon and Ed Deprettere, Feb., 1988 IEEE Journal on Selected Areas in Communications, pp. 353-363.

"Quantization Procedures for the Excitation in CELP Coders" by Peter Kroon and Bishnu Atal published in Apr. of 1987, pp. 1649, 1650, and 1652.

"Real-Time Vector APC Speech Coding at 4800 BPS With Adaptive Postfiltering" by Juin-Hwey and Allen Gersho, Apr., 1987, pp. 2185-2188.

"Adaptive Postfiltering of 16 kb/s-ADPCM Speech" by N. S. Jayant and V. Ramamoorthy, Apr., 1986 issue of Proceedings of the ICASSP, pp. 829-832.

"Spectral Smoothing Technique in PARCOR Speech Analysis-Synthesis" by Yoh'ichi Tohkura et al. appeared in Dec., 1978 issue of IEEE Transactions On Acoustics, Speech, and Signal Processing, pp. 587-596.

*Primary Examiner*—David D. Knepper

*Attorney, Agent, or Firm*—Steven G. Parmelee; John W. Hayes

[57] ABSTRACT

An adaptive spectral postfilter in a synthesized speech platform has a denominator characteristic that corresponds to a preceding LPC filter stage, and a numerator characteristic that is developed as a function of the denominator characteristic through application of spectral smoothing techniques. This allows the numerator to track the denominator without the introduction of spectral distortion that would otherwise affect the processing in an adverse way.

12 Claims, 1 Drawing Sheet

FIG. 1
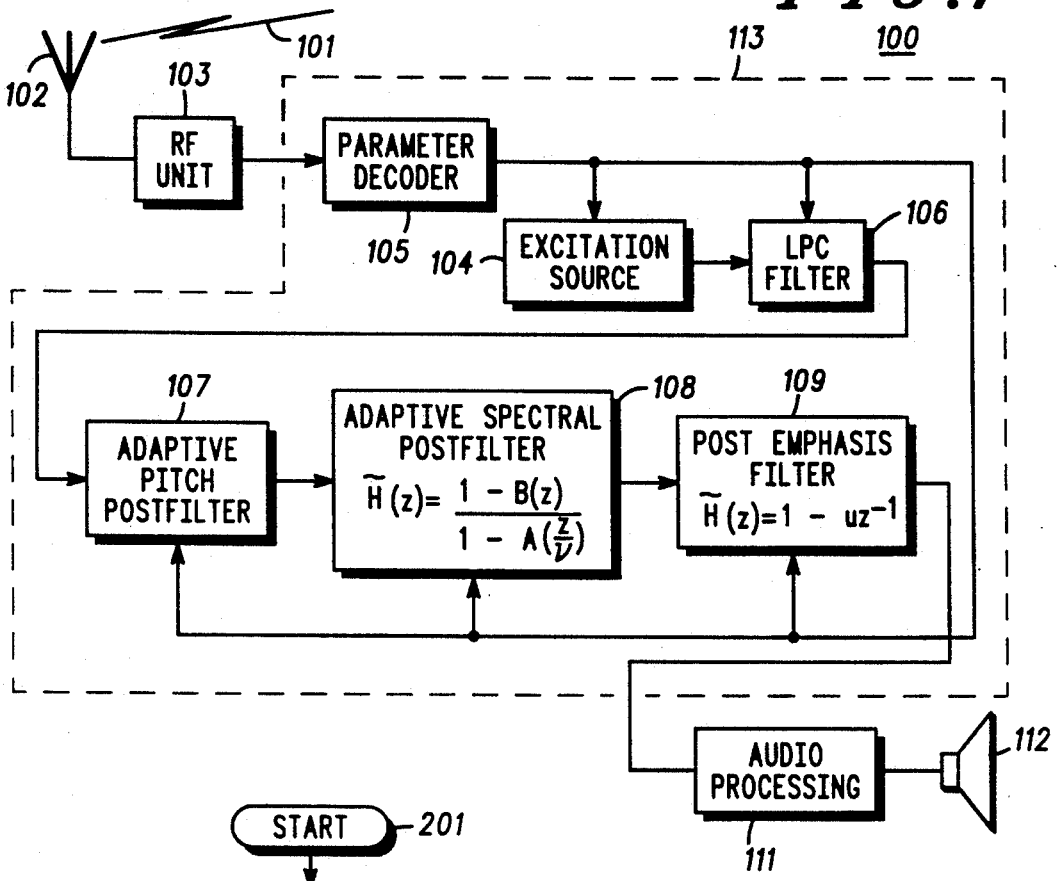
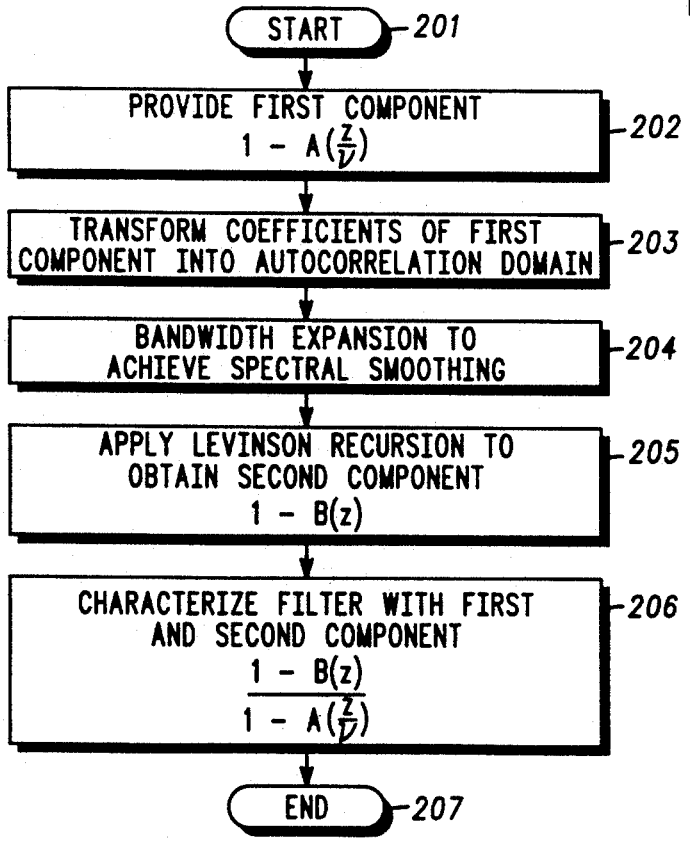
FIG. 2

DIGITAL SPEECH DECODER HAVING A POSTFILTER WITH REDUCED SPECTRAL DISTORTION

This is a continuation of application Ser. No. 07/422,926, filed Oct. 17, 1989 and now abandoned.

TECHNICAL FIELD

This invention relates generally to speech coders, and more particularly to digital speech coders that use postfilters to enhance the speech quality.

BACKGROUND OF THE INVENTION

Speech coders and decoders are known in the art. Some speech coders convert analog voice samples into digitized representations, and subsequently represent the spectral speech information through use of linear predictive coding. Other speech coders improve upon ordinary linear predictive coding (LPC) techniques by providing an excitation signal that is related to the original voice signal.

U.S. Pat. No. 4,817,157 describes a digital speech coder and decoder having an improved vector excitation source wherein a codebook of codebook excitation vectors is accessed to select a codebook excitation signal that best fits the available information, and is used to provide a synthesized speech signal from an LPC filter that closely represents the original.

Once the synthesized speech signal has been developed, various post-LPC filters are often used to further condition the signal. One such filter is an adaptive spectral postfilter (7hich is typically intended to enhance the perceptual quality of the synthetic speech), and another is a post emphasis filter (7hich contributes brightness to the synthetic speech result).

An adaptive spectral postfilter is typically of the general form:

$$\hat{H}(z) = \frac{1 - A\left(\frac{z}{\eta}\right)}{1 - A\left(\frac{z}{\nu}\right)},$$

where $0 \leqq \eta \leqq \nu < 1$ and $\frac{1}{1 - A(z)}$ represents the associated *LPC* filter.

The denominator term in the above postfilter representation emphasizes the formants in the synthetic signal spectrum, while attenuating the spectral valleys. (In the two extremes, setting $\nu=0$ results in an all-pass filter, while setting $\nu=1$ results in a denominator term that is the same as the associated LPC filter.) The numerator term attempts to cancel the general spectral shape introduced by the denominator. In prior art applications, $\nu$ is often set to about 0.8, and $\eta$ to about 0.5.

In practice, the numerator polynomial is only partially successful in tracking the spectral shape of the denominator (in effect, the spectral characteristic of the filter tilts with time), and that discrepancy typically manifests itself as a time varying modulation of the postfiltered speech brightness.

Accordingly, a need exists for a method of postfiltering synthesized speech that will both enhance the perceptual quality of the synthetic speech, while simultaneously minimizing detrimental impact on speech brightness. Preferably, speech brightness itself will be better controlled as well.

SUMMARY OF THE INVENTION

These needs and others are substantially met through provision of the postfilters disclosed herein. Pursuant to this invention, a postfilter can be provided, which postfilter is characterized by a first and second component. The first component includes a set of coefficients. These coefficients are transformed into an alternate domain set of parameters, and then operated on to provide a modified set of parameters. These are then used to provide a set of coefficients that characterize the second component.

In one embodiment, Z transform (filter) coefficients that represent the first component are converted to the autocorrelation domain. A spectral smoothing technique that makes use of a bandwidth expansion function is then applied to the autocorrelation sequence, and the second component polynomial coefficients are calculated from the modified autocorrelation sequence via the Levinson recursion. The first component is then used as the denominator, and the second component as the numerator, in the above noted filter characteristic.

Via this process, the numerator polynomial is replaced by a spectrally smoothed version of the $A(z/\nu)$ polynomial. Formant bandwidth expansion does not change the smoothed spectral envelope. Thus, the spectrally smoothed bandwidth expanded version of the $A(z/\nu)$ polynomial effectively minimizes time varying spectral tilt and allows the numerator to adaptively track the general spectral shape of the denominator and cancel it out.

In another embodiment, an additional post emphasis filter can be used to afford more control over postfiltered speech brightness. This filter is a first order filter of the form $$H(z) = 1 - uz^{-1}, \text{ where typically } 0.2 \leqq u \leqq 0.5.$$

BRIEF DESCRIPTION OF THE DRAWINGS

FIG. 1 comprises a block diagrammatic depiction of a radio configured in accordance with the invention; and FIG. 2 is a flowchart depicting the characterization of an adaptive spectral postfilter in accordance with the present invention.

BEST MODE FOR CARRYING OUT THE INVENTION

U.S. Pat. No. 4,817,157, entitled "Digital Speech Coder Having Improved Vector Excitation Source," as issued to Ira Gerson on Mar. 28, 1989, is incorporated herein by this reference. This reference describes in significant detail a digital speech coder and decoder. As detailed in the above noted reference, this invention can be embodied in a speech coder (or decoder) that makes use of an appropriate digital signal processor such as a Motorola DSP56000 family device.

In FIG. 1, a radio (100) embodying the invention includes an antenna (102) for receiving a speech coded radio frequency (RF) signal (101). An RF unit (103) processes the received signal to recover the speech coded information. This information is provided to a parameter decoder (105) that develops control parameters for various subsequent processes. An excitation source (104) as described above utilizes the parameters provided to it to create an excitation signal. This resultant excitation signal from the excitation source (104) is provided to an LPC filter (106) that yields a synthesized speech signal in accordance with the coded information. The synthesized speech signal is then pitch postfiltered (107) and spectrally postfiltered (108) to enhance the quality of the reconstructed speech. If desired, a post emphasis filter (109) can also be included to further enhance the resultant speech signal. (Additional details regarding the spectral postfilter (108) and the post emphasis filter (109) will be provided below.)

The speech signal is then processed in an audio processing unit (111) and rendered audible by an audio transducer (112). The excitation source (104), LPC filter (106), pitch postfilter (107), adaptive spectral postfilter (108), and post emphasis filter (109) can all be provided through appropriate programming of a DSP (113).

Pursuant to this invention, the adaptive spectral postfilter (108) is characterized by a first component (a denominator that is related to the filter characteristics of the LPC filter (106)) and a second component (a numerator that adaptively tracks the general spectral shape of the denominator to thereby cancel it out). The general form of such a filter can be found described in an article entitled "Real-Time Vector APC Speech Coding at 4800 bps With Adaptive Postfiltering," by Chen and Gersho, which appeared in the April, 1987 edition of the Proceedings of The International Conference on Acoustics, Speech, and Signal Processing, at pages 2185–2188, the contents of which are incorporated herein by this reference.

Pursuant to this invention, the numerator is developed by applying spectral smoothing techniques to the denominator polynomial. Such techniques are described in an article entitled "Spectral Smoothing Technique in PARCOR Speech Analysis-Synthesis," by Tohkura, Itakura, and Hashimoto, which appeared in the December, 1978 edition of the I.E.E.E. Transactions on Acoustics, Speech, and Signal Processing, the contents of which are incorporated herein by this reference.

In one embodiment, Z transform coefficients that represent the denominator are converted to the autocorrelation domain. (Examples of such conversions can be found in Markel, J. D. Gray, A. H., Jr.; Linear Prediction of Speech (Springer-Verlag, Berlin, Heidelberg, N.Y., 1976.) The spectral smoothing technique bandwidth expansion function is then applied to the autocorrelation sequence, with the numerator polynomial coefficients being calculated from the modified autocorrelation sequence via the Levinson recursion. In one embodiment, the autocorrelation coefficients are multiplied by the following factors to provide the resultant numerator coefficients:

| Autocorrelation Lag | Spectral Smoothing Factor |
|---|---|
| 0 | 1.0000000 |
| 1 | 0.9230769 |
| 2 | 0.7252747 |
| 3 | 0.4835164 |
| 4 | 0.2719780 |
| 5 | 0.1279896 |
| 6 | 4.9773753E-02 |
| 7 | 1.5718028E-02 |
| 8 | 3.9295070E-03 |
| 9 | 7.4847753E-04 |

-continued

| Autocorrelation Lag | Spectral Smoothing Factor |
|---|---|
| 10 | 1.0206513E-04 |

The denominator and numerator are then used to characterize the adaptive spectral postfilter (108).

It would of course also be possible to use the LPC filter information directly and to develop the numerator term therefrom through a similar process, since the LPC filter information is used to develop the denominator term as describe above.

Via this process, the numerator polynomial is provided by a spectrally smoothed version of the denominator polynomial. The spectrally smoothed bandwidth expanded version of the denominator polynomial effectively minimizes time varying spectral tilt and allows the numerator to adaptively track the general spectral shape of the denominator and cancel it out. Based upon listening tests, a bandwidth expansion factor (7hich specifies the degree of smoothing that is performed on the denominator) of about 1,200 Hz was used.

The flowchart of FIG. 2 aids in understanding the postfilter characterization process just described. As discussed previously, the adaptive spectral postfilter is characterized by a first component, or denominator, and a second component, or numerator. The first component, which can be expressed as:

$$1 - A\left(\frac{z}{\nu}\right)$$

is provided in block 202. In the subsequent step (203), th z-transform coefficients that represent the first component are converted to the autocorrelation domain. In block 204, a spectral smoothing bandwidth expansion function is applied to the autocorrelation sequence, and, in the subsequent block (205), the numerator (second component) polynominal coefficients are calculated from the autocorrelation sequence modified in the previous step (204), through the use of the Levinson recursion. The numerator, or second component, can be represented as:

$$1 - B(z)$$

Finally (206), the first and second components (denominator and numerator, respectively) are used to characterize the adaptive spectral postfilter, which can be represented as:

$$\frac{1 - B(z)}{1 - A\left(\frac{z}{\nu}\right)}$$

The post emphasis filter (109) may be provided to afford more control over postfiltered speech brightness. This filter is a first order filter of the form $$\tilde{H}(z) = 1 - uz^{-1}, \text{ where typically } 0.2 \leqq u \leqq 0.5.$$

We claim:

1. A method for producing a synthesized speech signal, comprising the steps of:

A) providing an excitation signal to a linear predictive coding filter;

B) provididng from the linear predictive coding filter a synthesized speech signal;

C) providing a speech synthesis postfilter that requires a first component and a second component;

D) providing the first component including a first set of coefficients;

E) transforming at least some of the first set of coefficients into an alternate domain set of parameters;

F) operating on the alternate domain set of parameters to provide a modified first set of coefficients;

G) using the modified first set of coefficients to provide the second component for use by the speech synthesis postfilter;

H) filtering the synthesized speech signal in the speech synthesis postfilter using the first component and the second component to provide a filtered synthesized speech signal, wherein the second component adaptively tracks the general spectral shape of the first component, thereby minimizing time-varying spectral tilt that would otherwise be introduced by this fitering step: and I) rendering the filtered synthesized speech signal audible.

2. The method of claim 1, wherein the linear predictive coding filter is at least partially defined by the expression:

$$\frac{1}{1 - A(z)}.$$

3. The method of claim 2, wherein the first component of the speech synthesis postfilter is of the &/rm $$1 - A\left(\frac{z}{\nu}\right)$$

as represented in Z transform notation.

4. The method of claim 3, wherein $\nu \approx 0.8$.

5. The method of claim 1, and further including the step of:

I) filtering the synthesized speech signal in a post emphasis filter substantially defined, in Z transform notation, as:

$$\widetilde{H}(z) = 1 - uz^{-1}$$

where $0.2 \leqq u \leqq 0.5$.

6. A method for producing a synthesized speech signal, comprising the steps of:

A) receiving a radio frequency signal that includes coded speech information;

B) recovering from the coded speech information an excitation signal;

C) providing the excitation signal to a linear predictive coding filter;

D) providing from the linear predictive coding filter a synthesized speech signal;

E) providing a speech synthesis postfilter that requires a first component and a second component;

F) providing a first component for use by the speech synthesis postfilter that includes a first set of coefficients;

G) transforming at least some of the first set of coefficients into an alternate domain set of parameters;

H) operating on the alternate domain set of parameters to provide a modified first set of coefficients;

I) using the modified first set of coefficients to provide the second component for use by the speech synthesis postfilter;

J) filtering the synthesized speech signal in the speech synthesis postfilter using the first component and the second component to provide a filtered synthesized speech signal, wherein the second component adaptively tracks the general spectral shape of the first component, thereby minimizing time-varying spectral tilt that would otherwise be introduced by this filtering step; and K) rendering the filtered synthesized speech signal audible.

7. The method of claim 6, wherein the linear predictive coding filter is at least partially defined by the expression:

$$\frac{1}{1 - A(z)}.$$

8. The method of claim 6, wherein the first component of the speech synthesis postfilter is of the form $$1 - A\left(\frac{z}{\nu}\right)$$

as represented in Z transform notation.

9. The method of claim 8, wherein $\nu \approx 0.8$.

10. The method of claim 6, and further including the step of:

I) filtering the synthesized speech signal in a post emphasis filter substantially defined, in Z transform notation, as:

$$\widetilde{H}(z) = 1 - uz^{-1}$$

where $0.2 \leqq u \leqq 0.5$.

11. The method of claim 1, 2, 3, 4, or 9 wherein the step of operating includes the step of multiplying.

12. The method of claim 1, 2, 3, 4, or 9 wherein the alternate domain set of parameters are auto-correlation domain parameters.

* * * * *

UNITED STATES PATENT AND TRADEMARK OFFICE

CERTIFICATE OF CORRECTION

PATENT NO. : 5,241,650

DATED : August 31, 1993

INVENTOR(S) : Ira A. Gerson et al.

It is certified that error appears in the above-identified patent and that said Letters Patent is hereby corrected as shown below:

In Column 5, line 3, replace "provididng" with --providing--.

In Column 5, line 35, replace "&/rm" with --form--.

Signed and Sealed this

Fifteenth Day of March, 1994

*Attest:*

*Attesting Officer*

BRUCE LEHMAN

*Commissioner of Patents and Trademarks*